US011453101B1

(12) United States Patent
James

(10) Patent No.: US 11,453,101 B1
(45) Date of Patent: Sep. 27, 2022

(54) PIPE JACK PIPE CLAMP

(71) Applicant: David R. James, Odessa, TX (US)

(72) Inventor: David R. James, Odessa, TX (US)

( * ) Notice: Subject to any disclaimer, the term of this patent is extended or adjusted under 35 U.S.C. 154(b) by 0 days.

(21) Appl. No.: 17/333,720

(22) Filed: May 28, 2021

(51) Int. Cl.
*B25B 5/10* (2006.01)

(52) U.S. Cl.
CPC ..... *B25B 5/10* (2013.01)

(58) Field of Classification Search
CPC .. B25B 5/10; B25B 5/104; B25B 5/14; B25B 5/147; B25B 5/067; B25B 5/101; B25B 5/082; B25B 5/00; B23Q 3/00; B23Q 3/06; B23Q 3/064; B23Q 3/08
USPC ..... 269/240, 244, 143, 249; 29/243.55, 257, 29/276; 248/628, 643, 231.71
See application file for complete search history.

(56) References Cited

U.S. PATENT DOCUMENTS

| | | | | |
|---|---|---|---|---|
| 4,074,899 | A * | 2/1978 | Hochstetler | B25B 5/101 269/902 |
| 5,135,209 | A * | 8/1992 | Penny | B25B 5/147 269/282 |
| 5,798,021 | A * | 8/1998 | Stiles | B25B 5/10 269/49 |
| 5,863,035 | A * | 1/1999 | Howell | B25B 5/10 269/902 |
| 6,431,534 | B1 * | 8/2002 | Orosz | B25B 5/163 269/268 |
| 7,004,682 | B1 | 2/2006 | Moody | |
| 8,608,143 | B2 | 12/2013 | Williams et al. | |
| 10,505,289 | B1 | 12/2019 | Trussell | |

OTHER PUBLICATIONS

Pipe Alignment Clamp. Product Listing [online]. Copyright 2021 arc-zone.com, Inc.® [retrieved on Dec. 27, 2019]. Retrieved from the Internet: <URL: https://www.arc-zone.com/Pipe-Alignment-Clamp-SHT-CPA>.

Pipe Rack Jack. Product Listing [online]. Copyright © 2021 Specialty Maintenance Products, Inc. [retrieved on Dec. 27, 2019]. Retrieved from the Internet: <URL: https://smptools.com/pipe-rack-jack/?jclid=CjwKCAiA58fvBRAzEiwAQW-hzda4QGFYH8Sx5NrK4H7V27TX9_E8GrayyZxHBgW8vRkpxd4V0ddoeBoC-QEQAvD_BwE>.

Fixed Leg Pipe Jacks. Product Listing [online]. (c) 2021 B&B Pipe and Industrial Tools [retrieved on Dec. 27, 2019]. Retrieved from the Internet: <URL: https://www.bbpipetools.com/fixedleg-jacks/>.

Pipe Clamp, 5 to12 In., Ultra Clamp. Product Listing [online]. © 2011-2021 Zoro Tools, Inc. [retrieved on Dec. 27, 2019]. Retrieved from the Internet: <URL: https://www.zoro.com/sumner-pipe-clamp-5-to12-in-ultra-clamp-781530/i/G6173422/>.

Pipe Clamp, Hold-E. Product Listing [online]. © 2011-2021 Zoro Tools, Inc. [retrieved on Dec. 27, 2019]. Retrieved from the Internet: <URL: https://www.zoro.com/sumner-pipe-clamp-hold-e-785000/i/G6190493/>.

* cited by examiner

*Primary Examiner* — Lee D Wilson
*Assistant Examiner* — Robert F Neibaur
(74) *Attorney, Agent, or Firm* — Cramer Patent & Design, PLLC; Aaron R. Cramer

(57) ABSTRACT

A pipe jack includes an outer "C"-shaped frame that is provided with two (2) inwardly-shaped tabs on each end. The tabs engage a lower surface of a head on a conventional pipe jack stand. An interior cradle is driven downward onto a surface of a pipe via a rod connected by a swivel joint. The rod passes through a nut on top of the frame and terminates with a crank handle on top.

20 Claims, 8 Drawing Sheets

PIPE JACK PIPE CLAMP

RELATED APPLICATIONS

None.

FIELD OF THE INVENTION

The presently disclosed subject matter is directed to a clamp and more specifically to a pipe jack pipe clamp.

BACKGROUND OF THE INVENTION

General construction, demolition, and maintenance working projects require a wide variety of power tools to accomplish the job properly. One tool that has proven itself worthy of inclusion in any tool collection is that of the pipe jack stand. These stands are equipped with a "V"-shaped head that holds pipe while being fitted, threaded, welded or during a variety of other processes. As the pipe must be rotated during these processes, the "V"-shaped head makes it ideal for allowing the pipe to turn but yet remain centered along its axis. However, there are some processes such as cutting, or attaching a thermowell where the user does not want the pipe to rotate.

Many resort to using conventional flat clamps that only connect along a thin line, or resort to the use of complicated chain clamps which can damage the pipe surface. Accordingly, there exists a need for a means by which a pipe in a "V"-shaped pipe jack stand can be clamped without the disadvantages as described above. The development of the pipe jack pipe clamp fulfills this need.

SUMMARY OF THE INVENTION

The principles of the present invention provide for a pipe clamp which comprises a workpiece and a pipe jack which itself comprises a pipe jack vertical adjustment moving a cradle relative to the pipe jack. The cradle has a cradle first side and a cradle second side which is attached to the movable member of the pipe jack vertical adjustment. The pipe clamp also comprises a brace which is removably attached to the cradle of the pipe jack. The brace includes a curvilinear portion which terminates in a first end and an opposing second end. The pipe clamp also comprises a stationary nut which is affixed to an upper side of the curvilinear portion and a clamp vertical adjustment which is adjusted relative to the brace. The clamp vertical adjustment includes a handle, a rod, and a guide.

The pipe clamp also comprises an aperture which passes through the stationary nut and an aligned section of the curvilinear portion, a first angled portion which extends away from the first end of the curvilinear portion at a downward angle towards the aperture; a second angled portion which extends away from the second end of the curvilinear portion towards the interior of the curvilinear portion at a downward angle relative to the stationary nut and the aperture and a guide which is attached to a first distal end of the rod. The guide has a movable nut which is affixed to an apex. The guide is shaped to enable contact on an upper surface of the workpiece and includes a plurality of different sizes to contact a plurality of different sizes of the workpiece that are supporting on the pipe jack.

The pipe clamp also comprises a handle which is attached to an opposing second distal end of the rod, a swivel adjustment which is disposed between the guide and the rod, and a post which is swivelly connected to the swivel adjustment. The post is attached to an apex of the guide. Attached adjacent to a terminal end of the first distal end of the rod is a first washer. Affixed to the terminal end of the first distal end of the rod is a second washer. Attached to an upper end of the post is a third washer having an equal outer diameter and inner diameter as the first washer. The handle resides on a first side of the brace and the guide resides on a second side of the brace.

The workpiece may be a pipe. The cradle may be a "V"-shaped metallic member where the cradle first side and the cradle second side are equidistant from a center point. The cradle nadir may be attached to the pipe jack vertical adjustment. The pipe jack may be commercially available. The brace may be adjustably secure the workpiece to the cradle of the pipe jack. The brace may be a unitary member having a uniform thickness. The rod may be entirely threaded about its circumference and longitudinally may adjust relative to the threaded aperture of the brace. The first angled portion may be capable of frictional securement against the cradle first side. The second angled portion may be capable of frictional securement against the cradle second side. The guide may be shaped as an inverted "V" and may have a uniform thickness.

The movable nut may be threadedly connected to the first distal end of the rod so as to enable the guide to be operably controlled thereby. The guide may include a pair of flared ends that terminate prior to the inner surface of the curvilinear portion, the first angled portion, and the second angled portion. The handle may be removably threaded onto the rod and may transfer a rotational motion from a user to the rod and the handle which vertically adjusts the clamp vertical adjustment relative to the brace - which enables adjustable positioning of the guide onto the workpiece. The pipe clamp may be removably placed and secured to the cradle to adjustably secure the workpiece between the pipe clamp and the pipe jack. The pipe clamp may be made of resilient material or of inert material. The pipe clamp may be made of lightweight material or may be made of material selected from the group consisting of carbon steel, stainless steel, aluminum, or plastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
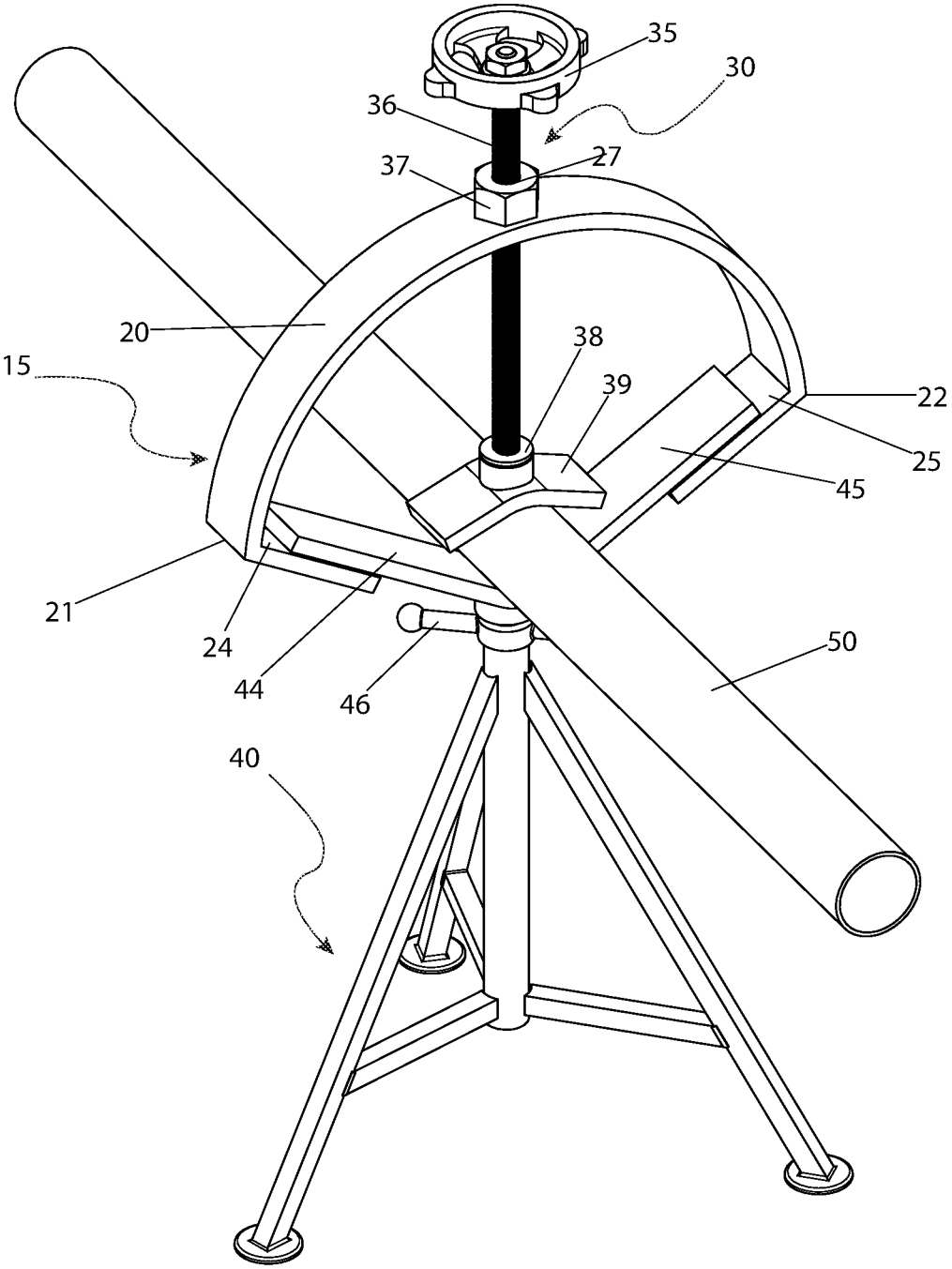
FIG. 1 is an environmental view of a clamp 10 clamping a workpiece 50 on a pipe jack 40, according to the preferred embodiment of the present invention.
Figure 2:
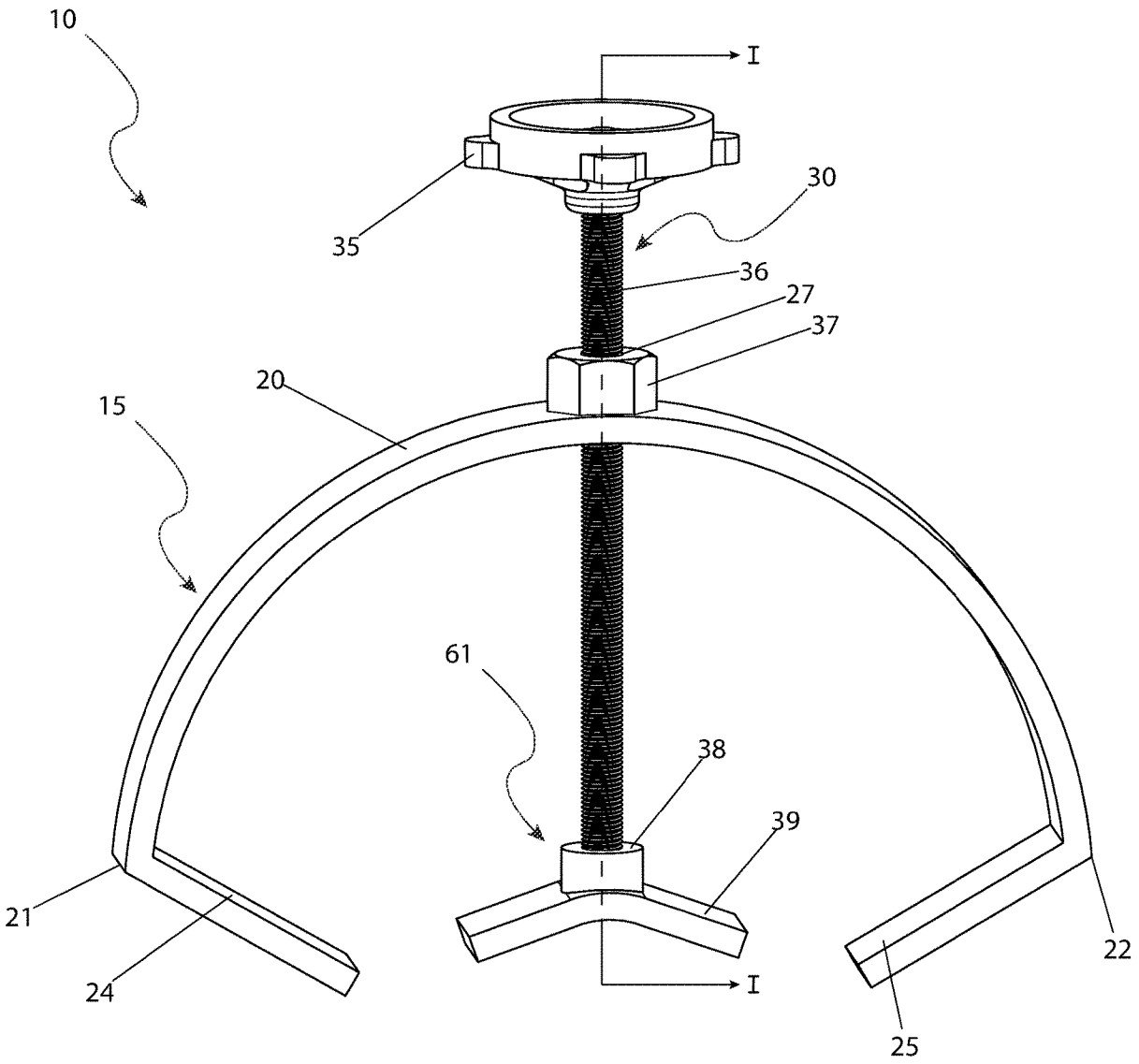
FIG. 2 is a top front perspective view of the pipe clamp 10, according to the preferred embodiment of the present invention.
Figure 3:
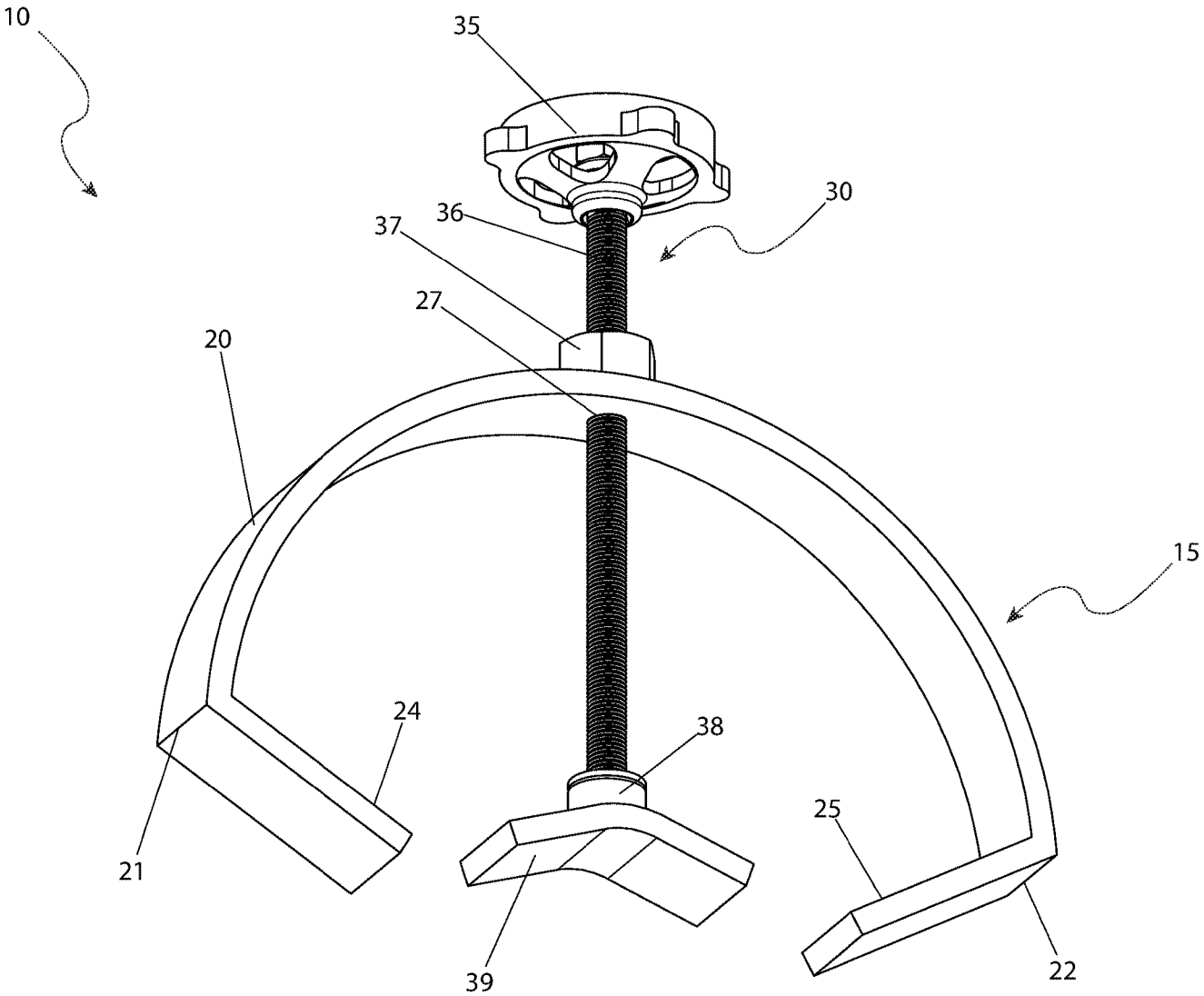
FIG. 3 is a bottom front perspective view of the pipe clamp 10, according to the preferred embodiment of the present invention.
Figure 4:
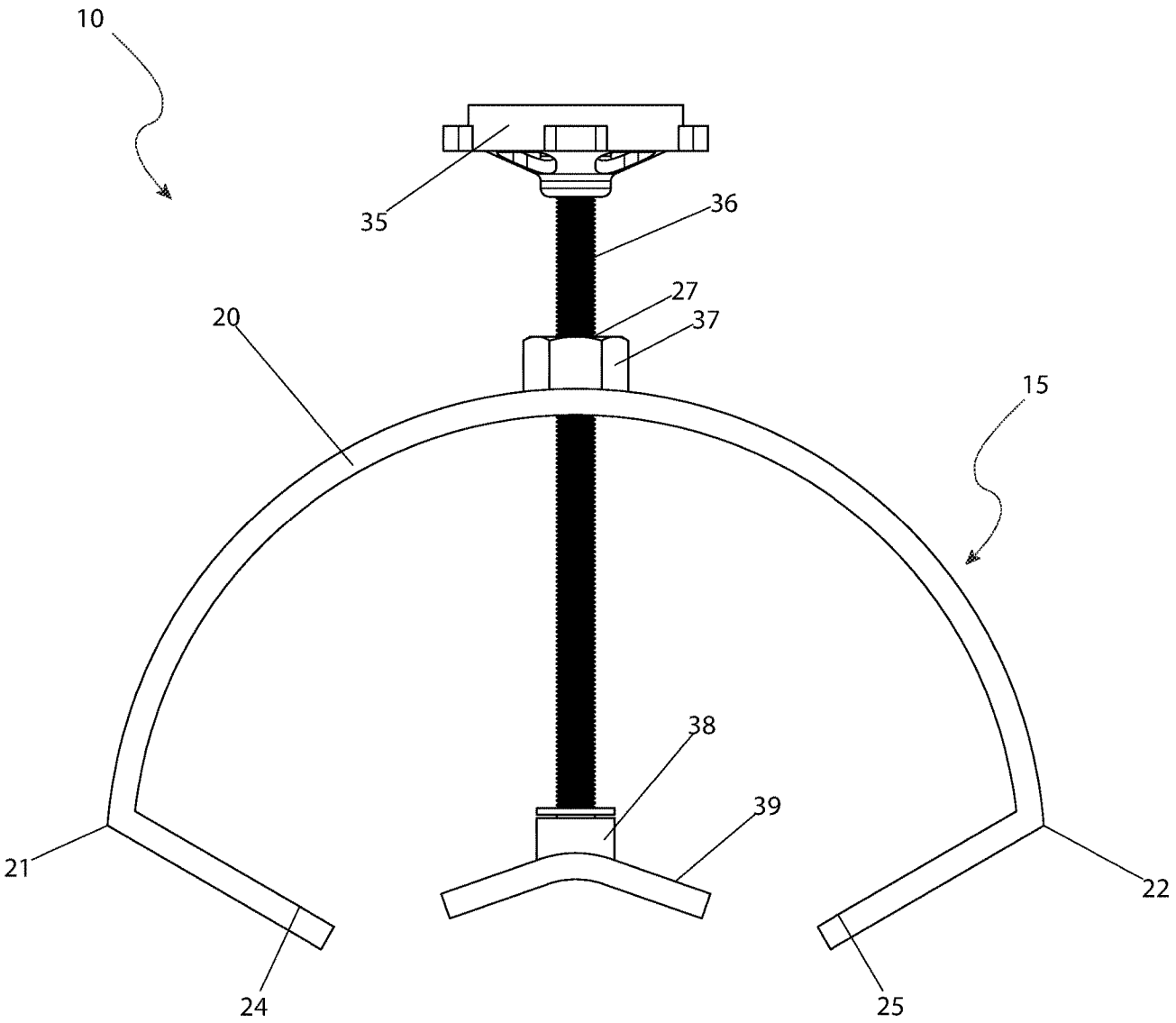
FIG. 4 is a front elevation view of the pipe clamp 10, according to the preferred embodiment of the present invention.
Figure 5:
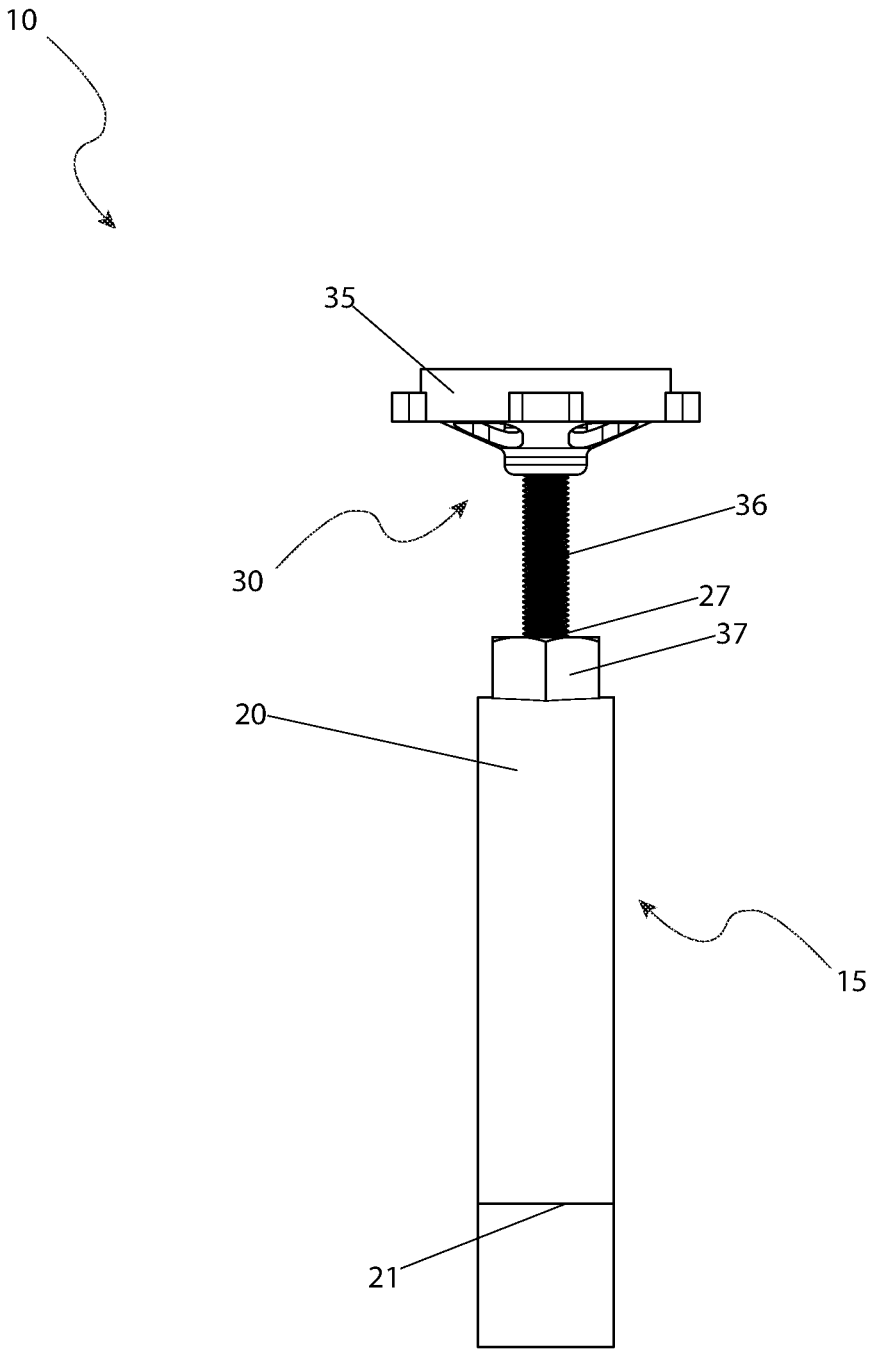
FIG. 5 is a side elevation view of the pipe clamp 10, according to the preferred embodiment of the present invention.
Figure 6:
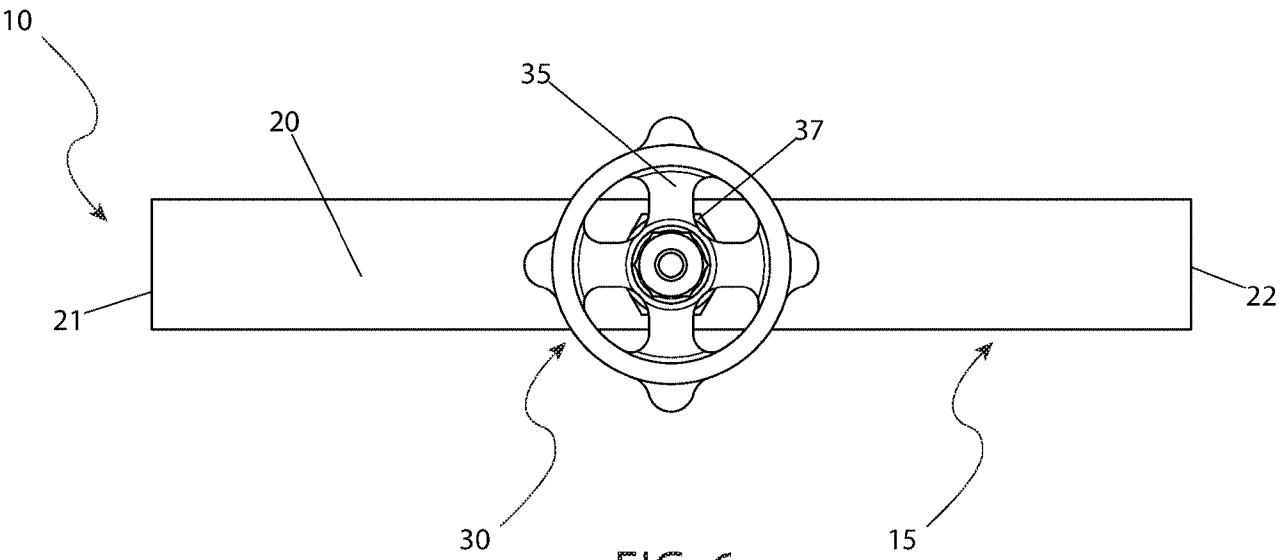
FIG. 6 is a top plan view of the pipe clamp 10, according to the preferred embodiment of the present invention; and, FIG. 7 is a bottom plan view of the pipe clamp 10, according to the preferred embodiment of the present invention.
Figure 7:
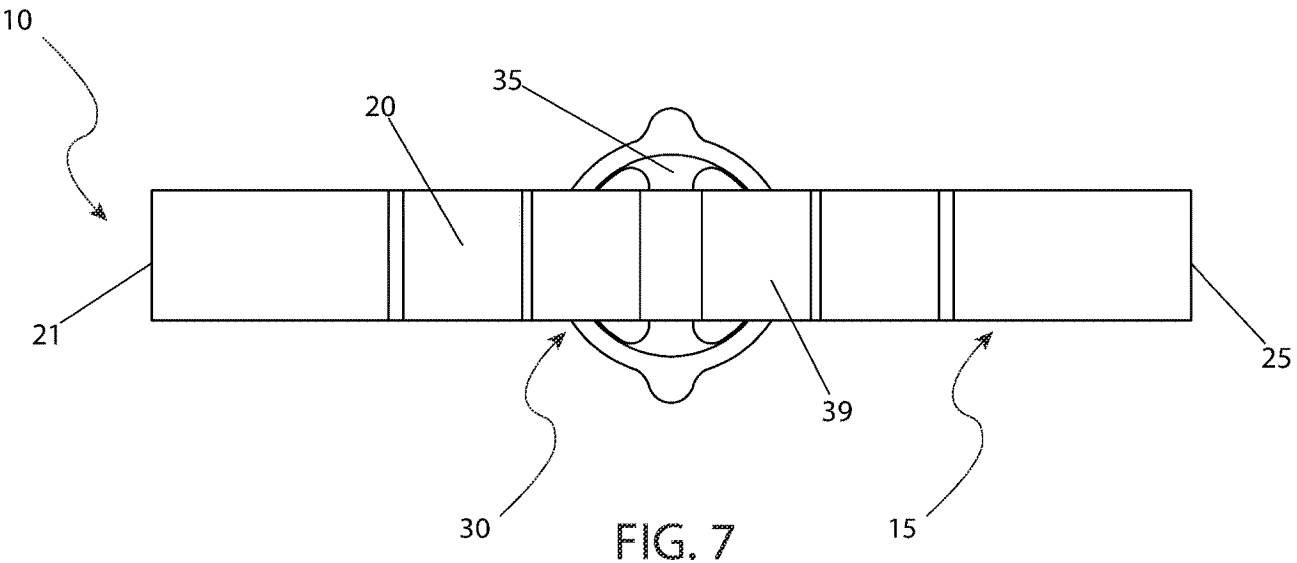

10 clamp
15 brace
20 curvilinear portion
21 first end
22 second end
24 first angled portion
25 second angled portion
27 aperture
30 clamp vertical adjustment
31 preferred swivel adjustment
32 first washer
33 second washer
34 third washer
35 handle
36 rod
37 stationary nut
38 post
39 guide
40 pipe jack
44 cradle first side
45 cradle second side
46 pipe jack vertical adjustment
50 workpiece
61 alternate swivel adjustment

DESCRIPTION OF THE PREFERRED EMBODIMENTS

Figure 8:
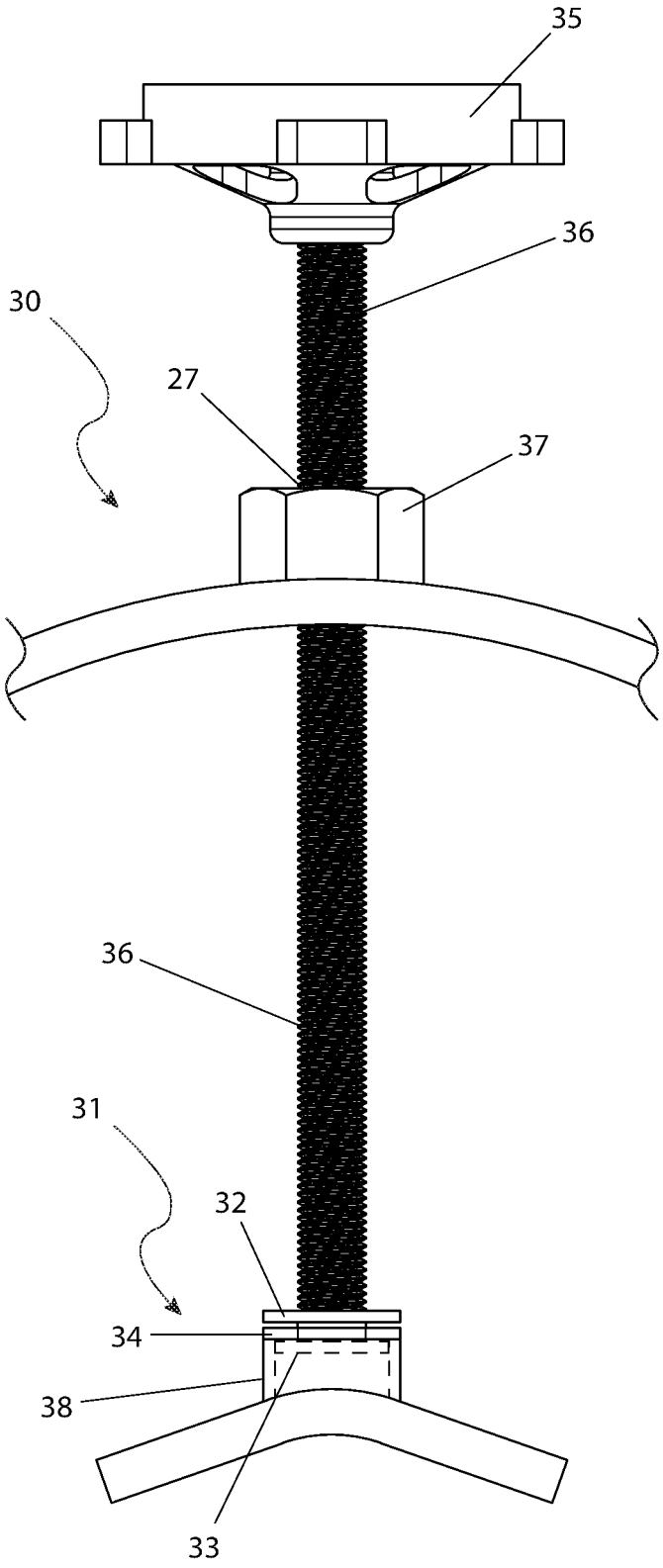
FIG. 8 is a cross-sectional view of the swivel adjustment 31 portion of the pipe clamp 10 along the line I-I (see FIG. 2), according to a preferred embodiment of the present invention; and, FIG. 9 is a top front perspective view of the pipe clamp 10, according to an alternate embodiment of the present invention.
Figure 9:
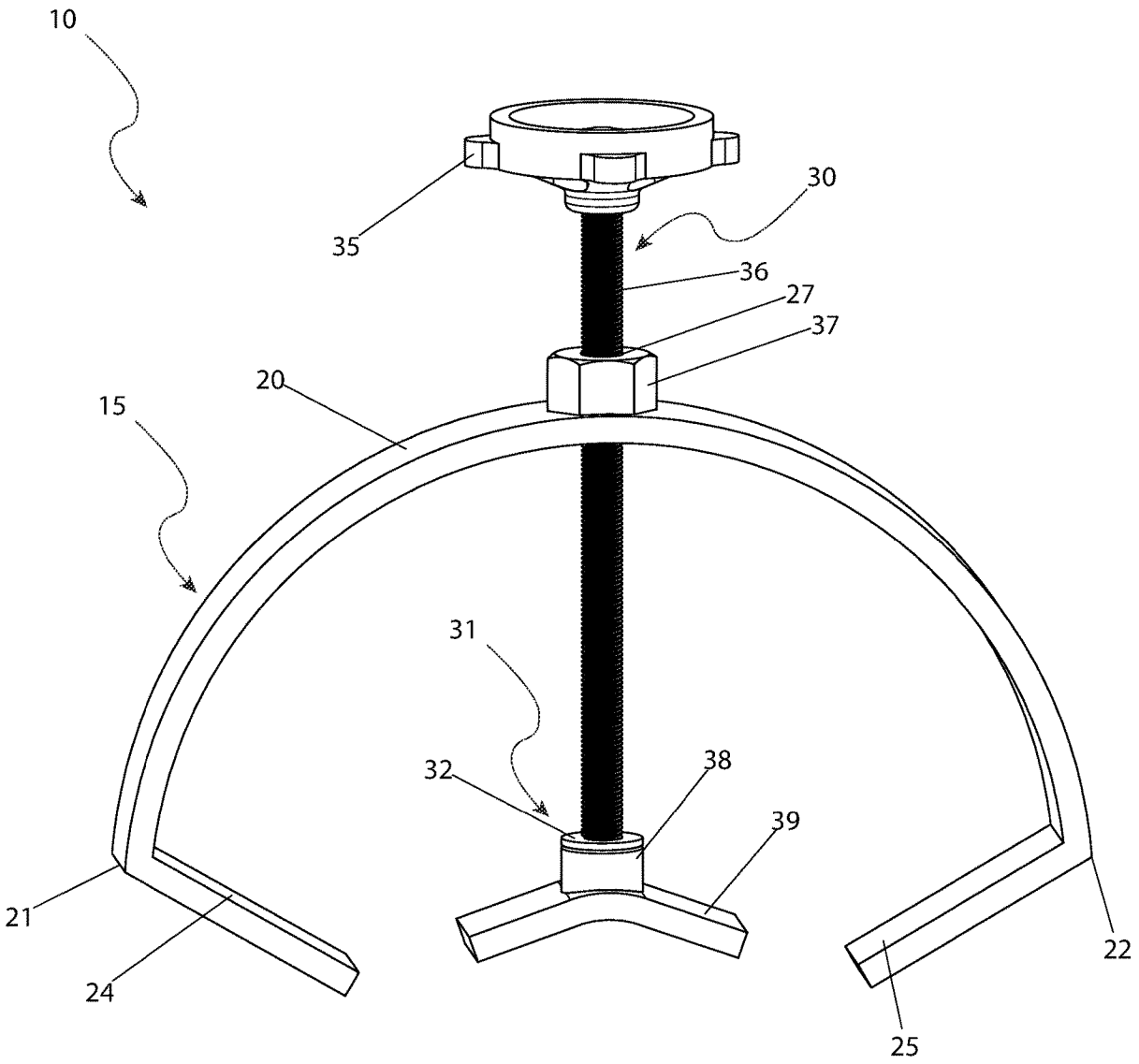

The best mode for carrying out the invention is presented in terms of its preferred embodiment, herein depicted within FIGS. 1 through 8, and alternately in FIG. 9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

FIG. 1 illustrates an exemplary embodiment of a pipe clamp 10 as it is securing a pipe 50 on a pipe jack 40. The pipe jack 40 is intended to be a commercially-available and conventional pipe jack 40, having a pipe jack vertical adjustment 46 that is capable of moving a cradle relative to the pipe jack 40. The cradle has a cradle first side 44 and a cradle second side 45 and is attached to the movable member of the pip jack vertical adjustment 46. The cradle is essentially a "V"-shaped metallic member where the cradle first side 44 and cradle second side 45 are equidistant from a center point, the nadir of which is attached to the pipe jack vertical adjustment 46. The pipe clamp 10 is capable of being removably placed and secured to the cradle to adjustably secure a workpiece 50 between the pipe clamp 10 and the pipe jack 40. It is appreciated that any type of elongated workpiece 50, such as a pipe or conduit, preferably but not limited to cylindrical shapes, can be adjustably secured as illustrated in FIG. 1. In an exemplary embodiment, the pipe clamp 10 is particularly suited to securing elongated cylindrical workpieces 50, such as pipes, having diameters of up to eight inches (8 in.), although most typically, the pipe clamp 10 is most beneficially suited for use on workpieces 50 having diameters of two to four inches (2-4 in.).

Referring now to FIGS. 2-8, there is shown various views of the pipe clamp 10. The pipe clamp 10 is preferably fabricated out of a resilient and relatively inert material, such as carbon steel, stainless steel, or a lightweight material such as aluminum or plastic. The pipe clamp 10 includes a brace 15 that is capable of removable attachment to a cradle of a pipe jack 40 and a clamp vertical adjustment 30 that is adjustable relative to the brace 15 and is the portion of the pipe clamp 10 that is capable of adjustably securing the workpiece 50 to the cradle of the pipe jack 40.

The brace 15 is a unitary member having a uniform thickness. The majority of the brace 15 includes a curvilinear portion 20, terminating in a first end 21 and an opposing second end 22. The curvilinear portion 21 has a continuous radius from a focal point (i.e., the center) and is shaped as a semi-circle. Located at the apex of the curvilinear portion 21 and in the center thereof, is a stationary nut 37 affixed to an upper side thereof. An aperture 27 is defined as passing through the entirety of the stationary nut 37, having an ID of five-eighths of an inch (⅝ in.) and the aligned section of the curvilinear portion 21. The aperture 27 is preferably threaded. The first end 21 and second end 22 are located nearly at diametric opposing sides of the curvilinear portion 20. Extending away from the first end 21 towards the interior of the curvilinear portion 21, at a downward angle relative to the aperture 27 is a first angled portion 24. Similarly extending away from the second end 22 towards the interior of the curvilinear portion 21, at a downward angle relative to the stationary nut 37 and aperture 27, is a second angled portion 25. The first angled portion 24 is capable of frictional securement against the cradle first side 44. Similarly, the second angled portion 25 is capable of frictional securement against the cradle second side 45.

The clamp vertical adjustment 30 includes a handle 35, a rod 36, a preferred swivel adjustment 31, and a guide 39. The rod 36 is an elongated cylindrical structure, preferably entirely threaded about its circumference, and capable of longitudinal adjustment relative to the threaded aperture 27 of the brace 15. Attached to a first distal end of the rod 36 is the preferred swivel adjustment 31 which is pivotally attached to the guide 39. The guide 39 is shaped as an inverted "V" with a uniform thickness and has a post 38 affixed to an apex thereof. In at least one (1) embodiment, the guide 39 is a one-quarter of an inch (¼ in.) thick piece of flat bar with an angled bend at the center of one hundred fifty-five degrees)(155°).

The preferred swivel adjustment 31 is attached to the first distal end of the rod 36. The post 38 is capable of a swivel connection to the preferred swivel adjustment 31. The guide 39 has flared ends that terminate prior to the inner surface of the curvilinear portion 21, first angled portion 24, and second angled portion 25 and thus do not interfere or contact those features. The guide 39 is so shaped to enable contact on an upper surface of a pipe 50 or any other workpiece. As such, the guide 39 may have different sizes to contact different sizes of workpieces 50 that are supporting on the pipe jack 40. Attached to an opposing second distal end of the rod 36 is handle 35. When the pipe clamp 10 is fully assembled, the handle 35 resides on one (1) side of the brace 15 and the guide 39 resides on the other side. The handle 35 is removably threaded onto the rod 36 and is capable of transferring a rotational motion from a user to the rod 36, and hence vertically adjusting the clamp vertical adjustment 30 relative to the brace 15, which ultimately enables adjustable positioning of the guide 39 onto the workpiece 50.

Other embodiments may provide for threading of the aperture 27 only coextensive the stationary nut 37 to be threaded and the aperture 27 comprising a smooth bore at the curvilinear portion 21.

Referring now more closely to FIG. 8, the preferred swivel adjustment 31 enables a generally limited swiveling attachment between the guide 39 and the rod 36. Attached adjacent to the terminal end of the first distal end of the rod 36 is a first washer 32. The first washer 32 can be affixed or threaded onto the rod 36. Affixed to the terminal point of the first distal end of the rod 36 is a second washer 33. The post 38, as aforementioned above, is attached to the apex of the guide 39 and is generally a cylindrical pipe having one and one-quarter of an inch (1¼ in.) in OD and is hollow. Attached to the upper end of the post 39 is a third washer 34, preferably having the same outer diameter and inner diameter as the first washer 32. The third washer 34 covers the top of the post 38 and entraps the first distal end of the rod 36 and the second washer 33 within the post 38. There is a gap of minimal clearance between the bottom surface of the first washer 32 and the upper surface of the third washer 34, as well as a gap of minimal clearance between the bottom of the third washer 34 and the top of the second washer 33. Such gaps are generally identical and can be one-thirty-second of an inch (1/32 in.). The first washer 32 and third washer 34 are envisioned to have five-eighths of an inch (⅝ in.) in ID, one and three-quarter inch (1¾ in.) in OD, and three-thirty-seconds of an inch (3/32 in.) in thickness. The second washer 33 is envisioned to be one-half of an inch (½ in.) in ID, one and three-eighths inch (1⅜ in.) in OD, and three-thirty-seconds of an inch (3/32 in.) in thickness.

FIG. 9 illustrates an embodiment where there is an alternate swivel adjustment 61 that replaces the preferred swivel embodiment 31. Such an alternate swivel embodiment 61 can be a caster swivel such as that commonly found on caster wheels.

2. Operation of the Preferred Embodiment

The preferred embodiment of the present invention can be utilized by the common user in a simple and effortless manner with little or no training. It is envisioned that the pipe clamp 10 would be constructed in general accordance with FIG. 1. The user would procure the pipe clamp 10 through normal procurement channels in a variety of colors and sizes, but the preferred embodiment may include options for gripping surfaces, handle 35 sizes and shapes, guide 39 sizes and shape, material of construction, and the like.

In the exemplary embodiment illustrated herein, if not previously assembled, the handle 35 is threadably attached to the second distal end of the rod 36. The rod 36 is then threadably attached to the aperture 27 and the stationary nut 37 of the brace 15, such that the first distal end is clearly obtainable. Thus, the pipe clamp 10 is ready for use.

In order to secure a workpiece 50 to the pipe clamp 40 for subsequent usage, the first angled portion 24 is placed under the cradle first side 44 and the second angled portion 25 is placed under the cradle second side 45 via manipulation of the preferred swivel adjustment 31 (or the alternate swivel adjustment 61 embodiment) portion of the guide 39. A workpiece 50 is then placed on the cradle of the pipe jack 40 and if necessary, the workpiece 50 is raised or lowered by use of the pipe jack vertical adjustment 46. The clamp vertical adjustment 30 is then adjusted to contact the workpiece 50. This is accomplished by manipulating the handle 35 until the guide 39 contacts the upper surface of the workpiece 50 and "clamps" the workpiece 50 to the pipe jack 40.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A pipe clamp, comprising:

a workpiece;

a pipe jack having a pipe jack vertical adjustment moving a cradle relative to the pipe jack, the cradle has a cradle first side and a cradle second side and is attached to the movable member of the pipe jack vertical adjustment;

a brace removably attached to the cradle of the pipe jack, the brace includes a curvilinear portion terminating in a first end and an opposing second end;

a stationary nut affixed to an upper side of the curvilinear portion;

a clamp vertical adjustment adjusted relative to the brace, the clamp vertical adjustment includes a handle, a rod, and a guide;

an aperture passing through the stationary nut and an aligned section of the curvilinear portion;

a first angled portion extending away from the first end of the curvilinear portion at a downward angle towards the aperture;

a second angled portion extending away from the second end of the curvilinear portion towards the interior of the curvilinear portion at a downward angle relative to the stationary nut and the aperture;

the guide is attached to a first distal end of the rod, the guide has a movable nut affixed to an apex thereof, the guide is shaped to enable contact on an upper surface of the workpiece and includes a plurality of different sizes to contact a plurality of different sizes of the workpiece that are supporting on the pipe jack;

the handle is attached to an opposing second distal end of the rod, the handle resides on a first side of the brace and the guide resides on a second side of the brace;

a swivel adjustment disposed between the guide and the rod;

a post swivelly connected to the swivel adjustment, the post is attached to an apex of the guide;

wherein attached adjacent to a terminal end of the first distal end of the rod is a first washer;

wherein affixed to the terminal end of the first distal end of the rod is a second washer;

wherein attached to an upper end of the post is a third washer having an equal outer diameter and inner diameter as the first washer.

2. The pipe clamp according to claim 1, wherein the workpiece is a pipe.

3. The pipe clamp according to claim 1, wherein the cradle is a "V"-shaped metallic member where the cradle first side and the cradle second side are equidistant from a center point.

4. The pipe clamp according to claim 1, wherein the cradle is attached to the pipe jack vertical adjustment, wherein the cradle is a cradle nadir.

5. The pipe clamp according to claim 1, wherein the pipe jack is commercially available.

6. The pipe clamp according to claim 1, wherein the brace is adjustably securing the workpiece to the cradle of the pipe jack.

7. The pipe clamp according to claim 1, wherein the brace is a unitary member having a uniform thickness.

8. The pipe clamp according to claim 1, wherein the rod is entirely threaded about its circumference and longitudinally adjusts relative to the aperture of the brace, wherein the aperture is threaded.

9. The pipe clamp according to claim 1, wherein the first angled portion is capable of frictional securement against the cradle first side.

10. The pipe clamp according to claim 1, wherein the second angled portion is capable of frictional securement against the cradle second side.

11. The pipe clamp according to claim 1, wherein the guide is shaped as an inverted "V".

12. The pipe clamp according to claim 1, wherein the guide includes a uniform thickness.

13. The pipe clamp according to claim 1, wherein the movable nut is threadedly connected to the first distal end of the rod so as to enable the guide to be operably controlled thereby.

14. The pipe clamp according to claim 1, wherein the guide includes a pair of flared ends that terminate prior to an inner surface of the curvilinear portion, the first angled portion, and the second angled portion.

15. The pipe clamp according to claim 1, wherein the handle is removably threaded onto the rod and transfers a rotational motion from a user to the rod and the handle vertically adjusts the clamp vertical adjustment relative to the brace, which enables adjustable positioning of the guide onto the workpiece.

16. The pipe clamp according to claim 1, wherein the pipe clamp is removably placed and secured to the cradle to adjustably secure the workpiece between the pipe clamp and the pipe jack.

17. The pipe clamp according to claim 1, wherein the first washer is affixed or threaded onto the rod.

18. The pipe clamp according to claim 1, wherein the post is a hollow cylindrical pipe 1¼ in. in outside diameter.

19. The pipe clamp according to claim 1, wherein the third washer covers the top of the post and entraps the first distal end of the rod and the second washer within the post.

20. The pipe clamp according to claim 1, wherein the pipe clamp is made of a lightweight material selected from the group consisting of carbon steel, stainless steel, aluminum, or plastic.

* * * * *